United States Patent [19]

Burroughs, Jr.

[11] Patent Number: 5,071,134

[45] Date of Patent: Dec. 10, 1991

[54] SUBSTANCE ABUSE BOARD GAME APPARATUS AND METHOD OF PLAY

[75] Inventor: Reford J. Burroughs, Jr., Verden, Okla.

[73] Assignee: Jerry L. West, Verden, Okla.

[21] Appl. No.: 663,745

[22] Filed: Mar. 1, 1991

[51] Int. Cl.[5] ..... A63F 3/00

[52] U.S. Cl. ..... 273/249

[58] Field of Search ..... 273/248-254, 273/243

[56] References Cited

U.S. PATENT DOCUMENTS

| | | | |
|---|---|---|---|
| 1,635,734 | 7/1927 | Ziegler | 273/249 |
| 4,121,823 | 10/1978 | McBride | 273/249 |
| 4,557,485 | 12/1985 | Lardon | 273/249 |
| 4,625,970 | 12/1986 | Childs et al. | 273/257 |
| 4,889,345 | 12/1989 | Wawryk | 273/249 |
| 4,900,033 | 2/1990 | Campos et al. | 273/249 |

*Primary Examiner*—Benjamin Layno

*Attorney, Agent, or Firm*—Bill D. McCarthy; Glen M. Burdick

[57] ABSTRACT

A board game apparatus is provided for educating the players about the consequences of the use of drugs and alcohol. Broadly, the invention comprises a game board having a playing path, a plurality of movable game pieces, a random number generator (a conventional six-sided die), a plurality of decks of question cards, a deck of penalty cards, and a plurality of challenge tokens. The playing path is formed by a plurality of segments or spaces, each of which is provided with an identifying indicia corresponding to an identifying indicia of either one of the decks of question cards or the deck of penalty cards and a plurality of corner penalty segments. The playing path is a modified, substantially inwardly disposed spiral having an outer level, an intermediate level and an inner level. The outer level consists of a plurality of four different randomly disposed segments and the corner penalty spaces; the intermediate level consists of a plurality of five different randomly disposed segments and the corner penalty spaces; and the inner level consists of a plurality of six different randomly disposed segments and the corner penalty spaces.

3 Claims, 2 Drawing Sheets

PICK THE BEST SIGN THAT
KIDS MAY BE USING DRUGS/ALCOHOL

A. STARTING TO LIE
B. MISSING CURFEW
C. EATING LESS
D. ALL THE ABOVE

48

FIG. 2A

YOUR SPOUSE LEFT YOU AFTER
LEARNING YOU GOT DRUNK
AND WENT HOME FROM A BAR
WITH ANOTHER MAN/WOMAN

GO BACK 4 SPACES

50

FIG. 2B

SUBSTANCE ABUSE BOARD GAME APPARATUS AND METHOD OF PLAY

BACKGROUND OF THE INVENTION

1. Field of the Invention

The present invention relates to a game board apparatus, and more particularly but not by way of limitation, to an instructional board game apparatus for teaching young people and adults the consequences of recreational use and abuse of drugs and alcohol.

2. Brief Discussion of the Prior Art

One of the most serious problems facing adolescents and adults is the consumption of drugs and alcohol, resulting in a dramatic increase in prison population and a high percentage of drug and alcohol-related traffic accidents. Therefore, additional avenues of informing the public in general, and young people in particular, of the dire and often tragic consequences of drug and alcohol abuse are constantly being sought.

It is well known that a person learns more readily when the person wants to learn and participates in an active learning experience. When the learning experience takes the form of a competitive game, the person often learns more rapidly and more permanently.

Numerous board games have heretofore been suggested as a means for obtaining physiological and personality information about the players, as well as for developing communication skills. Typical of such prior art board games is the psychotherapeutic testing game, disclosed in U.S. Pat. No. 4,216,594, which is designed to create a game playing atmosphere between a psychotherapeutic tester and a patient. The psychotherapeutic testing game includes a chance selection device and a plurality of cards bearing psychologically-oriented questions which elicit responses from the patient. The patient's responses determine an award related to the game apparatus and also yields psychological information to the tester.

U.S. Pat. No. 4,273,337 discloses a board game apparatus which promotes communication between parents and children regarding human sexuality. The apparatus includes a plurality of player tokens, a game board having a closed continuous path defined by a plurality of playing spaces, and a plurality of decks of cards. Each deck of cards contains questions concerning the field of human sexuality, the questions varying in degree of difficulty from deck to deck.

U.S. Pat. No. 4,682,956 provides an apparatus and method for learning about relationships and personalities among a group of players or participants, such as which player in the group is better known to the other players and which player knows the other players better. The apparatus includes tokens to be moved on a board in combination with a plurality of colored cubes, scoring sticks, secret answer wheels and question cards. Movement of a player's token, as well as scoring, is controlled in part by chance and in part by the player's knowledge of the other participants, as revealed by the player's secret answers to questions concerning the feelings and intentions of the participants.

An educational game for student and graduate nurses is disclosed in U.S. Pat. No. 4,372,559. The game provides playing pieces, called "clients", and a playing board having a plurality of contiguous areas around the perimeter of the board with additional areas in the center of the board. Two decks of cards govern admission to and play on the playing board, each card of the decks having a medical question with multiple choice answers on one side and a single correct answer on the other side. The object of the game is to move a player's client around the perimeter of the board, through an acute stage, an intermediate stage and a convalescent stage of illness, and back to the community through a correct selection and use of medical alternatives.

U.S. Pat. No. 4,216,966 discloses a board game apparatus based on possible experiences of a person who consumes liquor. The board game apparatus includes a board having a pathway upon which a player's token is advanced by roll of a pair of dice from a start/finish location through various stops, each stop representing a liquor establishment where liquor might be consumed. At each stop a card drawn from the deck specifies an amount of liquor consumed along with an elapsed time. The amount of liquor consumed and the elapsed time in each of the liquor establishments represented by the stops are recorded on a display board. Information from the display board is transferred to a blood alcohol chart which indicates the player's sobriety or drunkenness. If a player is found to be drunk, his sober player token is changed to a token indicating drunkenness and a police car is put into play by use of a second pair of dice. The police car has no effect on a sober player token but can force a drunken player token to go around the board once more.

While numerous board game apparatus have heretofore been developed for educating the players on a particular subject matter, a need remains for providing educational materials to people on the consequences of the recreational use and abuse of drugs and alcohol. It would be highly desirable if such educational materials could be conveyed to a person by participation in a competitive game. It is to such a means for educating persons about the consequences of the recreational use and abuse of drugs and alcohol that the present invention is directed.

SUMMARY OF THE INVENTION

According to the present invention a board game apparatus is provided for educating the players about the consequences of the use of drugs and alcohol. Broadly, the invention comprises a game board having a playing path, a plurality of movable game pieces, a random number generator (a conventional six-sided die), a plurality of decks of cards containing question cards, a deck of penalty cards, and a plurality of challenge tokens. The playing path is formed by a plurality of segments or spaces, each of which is provided with an identifying indicia.

The playing path begins near one corner of the game board and moves in a modified inward spiral through an outer level, an intermediate level and an inner level, to a goal in the center portion of the game board. In each successive level, the number of indicia employed to identify the segments or spaces increases by one. The playing path also includes a corner penalty segment located at each corner of the modified inward spiral. Each of the corner penalty segments contains printed instructions which must be followed by a player whose game piece lands on a penalty space.

Each deck of question cards is provided with an identifying indicia which corresponds to the identifying indicia of spaces of the playing path. The cards in each of the decks of question cards contain questions and answers intended to educate the players about specific areas of drug and alcohol abuse; and each of the question cards in the deck relates to the same aspects of substance abuse. For example, each card in one deck of question cards relates to adolescent drug abuse and peer pressures, whereas each card in another deck of question cards relates to recovery.

The deck of penalty cards, which is provided with an identifying indicia corresponding to the identifying indicia of certain segments or spaces in the playing path (i.e., penalty spaces) comprises cards which describes some aspect of drug and alcohol abuse, such as "Driving While Intoxicated" or "Conviction of Possession of Marijuana". Further, the penalty cards contain requirements which the player must follow, such as moving in a backward direction along the playing path a specified number of spaces.

Play of the substance abuse board game apparatus of the present invention begins from a "start" position on the game board. The first player (hereinafter referred to at times has the "active player") rolling the die will move his/her game piece a number of spaces along the playing path corresponding to the number shown on the die. A card is then selected by another player from either the deck of penalty cards, if the identifying indicia of the space to which the active player's game piece is moved corresponds to the identifying indicia of the deck of penalty cards or from the deck of question cards which has the same identifying indicia as the identifying indicia of the space to which the active player moved his/her game piece. When the active player's game piece comes to rest on a penalty space, the active player must follow the instructions on a card drawn from the deck of penalty cards and thereafter pass the die to the next player. On the other hand, when the active player's game piece comes to rest on a space or segment other than a penalty space or corner penalty segment, a card is selected from the deck of question cards having the same identifying indicia as the identifying indicia of the space to which the active player's game piece is moved. The question contained on the card is then read to the active player. If the active player gives a correct answer to the question on the question card, the active player will again roll the die and advance the game piece the designated number of spaces along the playing path indicated by the die. A card is again selected from the deck of cards having the identifying indicia corresponding to the identifying indicia to which the active player's game piece has been moved and the question on the card is read to the active player. The active player attempts to answer the question and, if the correct answer is given, the active player is allowed to roll the die again. In the event the active player gives an incorrect answer to the question on the question card, the die is passed to the player on the right. When play returns to the player who had previously given the incorrect answer, the question which was previously missed is again read. If a correct answer is now given, the player may then roll the die and advance his/her game piece the number of spaces indicated on the die. However, if another incorrect answer is given, the die will again be passed to the player on the right. Thus, a correct answer to the question must be given by the player before the player will be allowed to roll the die and advance his/her game piece.

When a player's game piece is moved so as to land on a corner penalty segment, the player is required to follow the instructions contained on the corner penalty segment, such as "D.U.I. School-Roll Again", "Skip 1 Roll", "Free Roll" and the like.

One time during the game, when it is a player's turn, he/she may challenge an other player by using his/her challenge chip. When a player challenges another player, the challenger must correctly answer questions from four different question cards drawn by the challenged player from four different decks of question cards. If all four questions are answered correctly by the challenger, the challenger moves his/her game piece to the space on the playing path previously occupied by the challenged player's game piece and the challenged player's game piece is moved to the space on the playing path previously occupied by the challenger's game piece. However, if any of the four questions are answered incorrectly, the challenger must return to the "start" position on the game board.

In order to win the game, a player moves his/her game piece along the playing path through the outer (abuse) level, the intermediate (recovery) level and the inner (counselor) level and onto the space designated "COUNSELOR", thereby "occupying" the position of counselor. To occupy the counselor space, the player must roll a number on the die corresponding to the number of spaces required to place the player's game piece on the space so designated. For example, if one space is require to occupy the counselor space, a "1" must be rolled on the die. However, a player may advance on the counselor path if the number rolled on the die is less than the number of spaces required to occupy the position of counselor.

When the counselor space is correctly reached, the player must give a correct answer to a question card selected from each deck of question cards before being declared counselor/winner. If a question from one of the cards is missed, the player loses his/her turn and must wait until his/her next turn before getting another chance to answer the question correctly.

An object of the present invention is to provide a game board apparatus and method of play wherein the players are educated about the consequences of substance abuse.

Another object of the present invention, while achieving the before-stated object, is to provide a competitive, fun-filled game board apparatus wherein the players learn the consequences of recreational use and abuse of drugs and alcohol.

Other objects, features and advantages of the present invention will be apparent from the following detailed description when read in conjunction with the drawings and appended claims.

BRIEF DESCRIPTION OF THE DRAWINGS

FIG. 2A is an isometric view of a typical question card; and

FIG. 2B is an isometric view of a typical penalty card.

DETAILED DESCRIPTION

Figure 1:
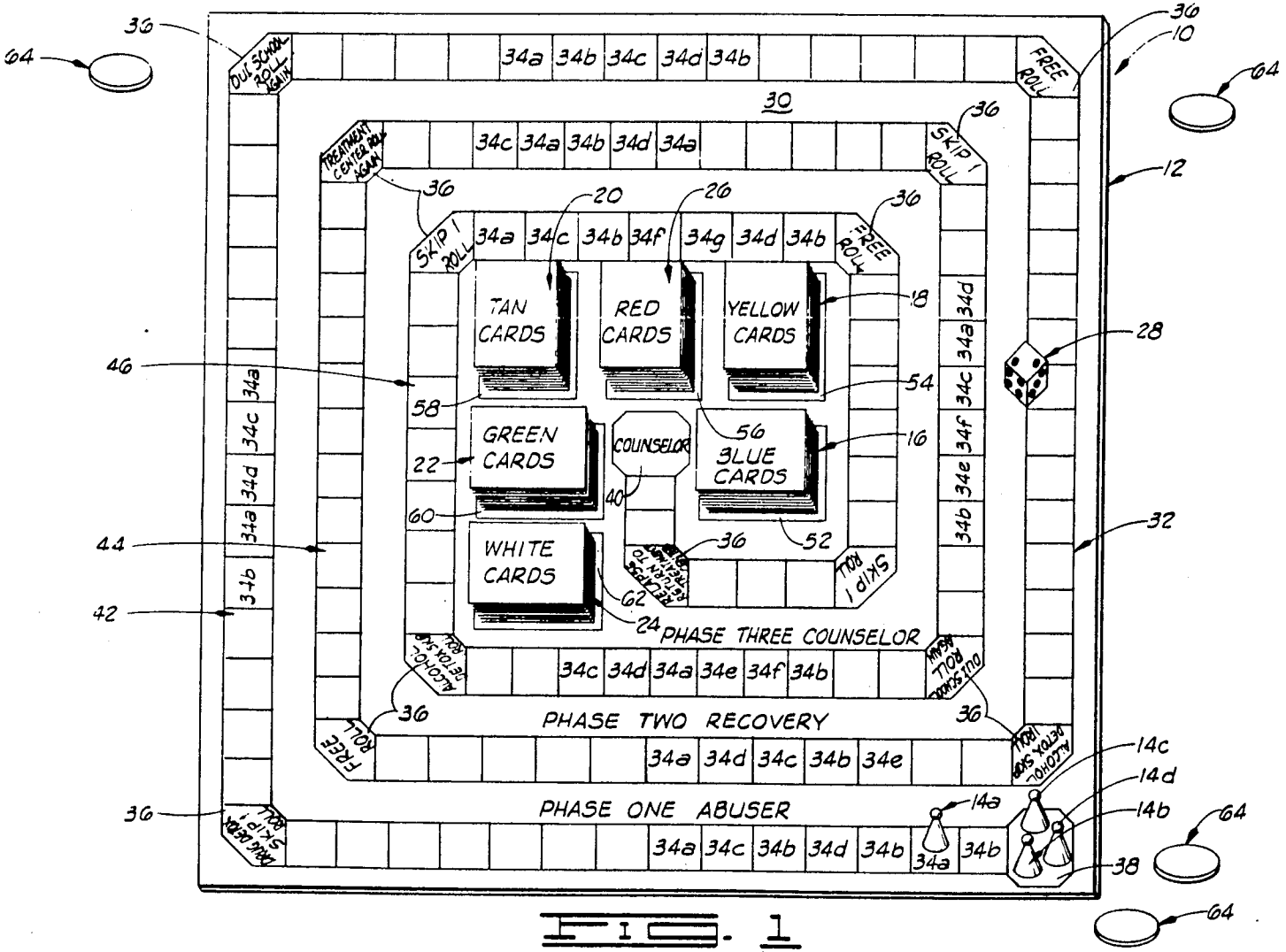
FIG. 1 is an isometric view of a substance abuse board game apparatus constructed in accordance with the present invention.

Turning now to the drawings, and more particularly to FIG. 1, a substance abuse board game apparatus 10 of the present invention is illustrated. The substance abuse board game apparatus 10 (hereinafter referred to as board game apparatus 10) comprises a game board 12, a plurality of movable game pieces, such as game pieces 14a-14d, a plurality of decks of question cards 16, 18, 20, 22 and 24, a deck of penalty cards 26, and a random number generator, such as a die 28. The game board 12 is provided with a substantially planar playing surface 30 having a playing path 32 formed thereon by a plurality of randomly positioned playing spaces or segments 34a-34f (only a portion of which are shown) and a plurality of corner penalty spaces or segments 36. Each of the playing spaces 34a-34f is provided with an identifying indicia corresponding to an identifying indicia on one of the decks of question cards 16-24 and the deck of penalty cards 26; and the playing spaces 34a-34f are randomly arranged so that each playing space has a different identifying indicia than the identifying indicia of an adjacently disposed playing space.

While any suitable identifying indicia can be employed to identify the playing spaces or segments 34a-34f, penalty corner space segments 36, and the cards of the decks of question cards 16-24, desirable results have been obtained wherein the segments 34a-34f and thus the decks of question cards 16-24 are designated by the colors blue, yellow, red, tan, green and white, and the penalty corner spaces are designated in red.

The playing path 32 extends from a starting segment or square 38 located in one corner of the game board 12 and defines a multi-level path to a counselor position 40 located in the center portion of the game board 12. The playing path 32 can be characterized as a modified, substantially inwardly disposed spiral having an outer level 42, an intermediate level 44 and an inner level 46. That is, each of the outer level 42, the intermediate level 44 and the inner level 46 is substantially rectangular in configuration. One of the corner penalty segments 36 is located at each corner portion of the outer level 42, the intermediate level 44 and the inner level 46 substantially as shown.

The outer level 42, which consists of the playing segments 34a, 34b, 34c, 34d and the corner penalty segments 36, constitutes a "Phase I Abuser" level; the intermediate level 44, which consists of the playing segments 34a, 34b, 34c, 34d, 34e and the corner penalty segments 36, constitutes a "Phase II Recovery" level; and the inner level 46, which consists of the playing segments 34a, 34b, 34c, 34d, 34e, 34f and the corner penalty segments 36, constitutes a "Phase III Counselor" level. That is, the outer level 42 which constitutes the "Phase I Abuser" level, is composed of four different playing segments and the corner penalty segments 36; the intermediate level 44, which constitutes the "Phase II Recovery" level, is composed of five different playing segments and the corner penalty segments 36; and the inner level 46, which constitutes the "Phase III Counselor" level, is composed of six different segments and the corner penalty segments 36.

As previously stated, each of the playing spaces or segments 34a-34f in the playing path 32 is provided with an identifying indicia which corresponds to an identifying indicia on one of the decks of the question cards 16-24 or to an identifying indicia of the deck of penalty cards 26. Thus, when a player's game piece is moved to one of the playing segments, such as the playing segment 34a in the outer level 42 of the playing path 32, a card is selected by another player, such as the player on the right, from the deck of question cards which has an identifying indicia corresponding to the identifying indicia of the playing segment 34a, such as the deck of question cards 16. For the player to continue play, he/she must correctly answer the question on the selected card. If the player gives an incorrect answer to the question, the player loses his/her turn and the die is passed to the next player.

Each card of the decks of question cards 16, 18, 20, 22 and 24 contains a question with multiple choice answers on one side thereof, all relating to various phases of substance abuse. That is, the deck of question cards 16 contains cards having questions relating to alcohol use by adults and children; the deck of question cards 18 contains cards having questions concerning the use of drugs by adults and children of alcoholic parents; the deck of question cards 20 contains cards having questions relating to recovery from substance abuse; the deck of question cards 22 contains cards having questions relating to counseling; and the deck of question cards 24 contains cards having questions relating to adolescent drug use and peer pressure. A typical question card, such as a card 48 of the deck of cards 16 is illustrated in FIG. 2A. As can be seen, a question relating to alcohol use by adults and children is printed on one side of the card 48, together with four possible answers. The correct answer to the question on the card 48 is indicated by a suitable marking (e.g., asterisk, bold print, underlining, etc.).

On the other hand, the deck of penalty cards 26 contains cards having information relating to criminal penalties for drug and alcohol abuse, together with instructions to the player to move in a specified manner (usually to move the player's game piece a number of spaces backwards or to forfeit a turn and the like). A typical card 50 of the deck of penalty cards 26 is illustrated in FIG. 2B.

The decks of question cards 16-24 and the deck of penalty cards 26 are stacked on indicated areas, such as box-shaped areas 52, 54, 56, 58 60, and 62 imprinted on the game board 12. Each box-shaped area has an identifying indicia corresponding to the particular deck of cards to be positioned thereon.

As previously set forth, each of the outer level 42, the intermediate level 44 and the inner level 46 of the playing path 32 is provided with the corner penalty segment 36 in each corner thereof. When a player's game piece is moved to one of the corner penalty segments 36, the player is required to follow the instructions printed on the corner penalty segment 36, such as "Drug Detox-Skip One Roll", "D.U.I. School-Roll Again", "Free Roll", "Skip One Roll", and the like.

The board game apparatus 10 of the present invention further comprises a plurality of challenge chips 64. One challenge chip 64 is issued to each of the players at the beginning of the game. The challenge chip 64 may be used only one time during the course of the game and use of the chip by a player permits that player (when it is the player's turn) to challenge any other player.

When a player challenges another player, the challenged player selects one card from four of the five decks of question cards, such as a card from the deck of question cards 16, 18, 22 and 24. The challenger then attempts to answer the questions on the four question cards. If the four questions are answered correctly, the challenging player (i.e. the challenger) will move his/her game piece to the playing space previously occupied by the player being challenged (i.e. the challenged player's) game piece, and the challenged player's game piece is moved to the space previously occupied by the challenger. On the other hand, if any question is answered incorrectly, the challenger must move his/her game piece to the "start" position, i.e., the starting segment 38 of the playing path 32.

Turning now to the method of playing the substance abuse board game apparatus 10 of the present invention, the winner is the first player who makes one complete trip around the playing path 32, starting on the starting space 38 and ending in the counselor position 40, and who correctly answers a question on a card selected from each of the decks of question cards 16, 18, 20, 22 and 24.

Play utilizing the substance abuse board game apparatus 10 begins by each of the players selecting a game piece, such as the game pieces 14*a*-14*d*; and each player is issued one challenge chip 64. Each of the game pieces 14*a*-14*d* is of a different color (e.g., red, blue yellow, green, etc.) or shape so that each player's movement along the playing path 32 can be readily identified without confusion. The first active player then rolls the die 28 and moves the number of spaces indicated on the die along the playing path. In FIG. 1 the first player has rolled the die 28 and moved the game piece 14*a* two spaces or segments along the playing path to the segment designated 34*a*. The segment 34*a* has an identifying indicia corresponding to the identifying indicia on the deck of question cards 24. Thus, the player on the right of the active player draws one card from the deck of question cards 24 and reads a question printed on the card to the active player. If the active player correctly answers the question, the active player will again roll the die 28 and advance the game piece 14*a* a number of spaces corresponding to the number on the die 28. A card will then be selected by the player to the right of the active player from the deck of cards having an identifying indicia corresponding to the identifying indicia of the space to which the active player's game piece 14*a* has been moved. If another correct answer is given, play will continue. However, if an incorrect answer is given, play will be passed to the next player. When play returns to the player who previously missed a question, the player must first answer the question previously missed prior to being allowed to roll the die 28 and continue to advance along the playing path 32. Each question card will contain no more than four answer choices. Thus, a player unfamiliar with the subject matter on the card will miss the question at most three times.

When a player is traveling along the playing path 32 and the game piece lands on one of the penalty corner segments 36, the player will follow the instructions printed on the penalty corner segment 36. On the other hand, if a player's game piece is moved to a segment having an identifying indicia corresponding to the identifying indicia of the penalty cards 26, a card is drawn from the deck of penalty cards 26 and the player follows the instructions printed on the card. Play is then passed to the next player.

As previously stated, each player is issued a challenge chip 64 at the start of play. When it is the player's turn, the player may challenge any other player one time during play of the game. When a player challenges another player, the challenger surrenders his/her challenge chip 64 and thereafter must answer four questions on cards selected from any of the five decks of question cards, namely decks 16, 18, 20, 22 and 24. The four cards will be picked by the challenged player. If all four questions are answered correctly, the challenger will exchange the position of his/her game piece on the playing path 32 with the position of the challenged player's game piece. If any of the four questions is answered incorrectly, the challenger returns his/her game piece to the start segment.

As previously set forth, the winner of the game is the first player to travel the playing path 32 and enter the position of counselor. In order to enter the counselor position 40, the player must roll the correct number on the die 28 to advance the game piece into the counselor position 40. For example, if a movement of a game piece of two spaces is required for the player's game piece to enter the counselor position 40, the die must be rolled with a "2" or less. If a "1" is rolled, the game piece may be moved one space or segment by the player and the die 28 may be rolled again. However, if the die 28 indicates "3" and only a movement of two spaces is required to enter the counselor position 40, the player passes the die 28 to the next player.

When the counselor position 40 is correctly reached, the player on the right of the player entering the counselor position 40 draws a card from each of the decks of question cards 16, 18, 20, 22 and 24. The questions on the cards are then read to the player. If the player correctly answers each question, that player is declared counselor/winner. However, if a question is missed, that player must wait until his or her next turn before being given another chance to answer the missed question correctly.

Thus, the goal of the game is to be the first one to work through all three phases (i.e., abuse phase, recovery phase and counselor phase) of the playing path 32 and then answer correctly a question from each of the six decks of cards, namely decks 16-26. During play of the game, the participants are educated concerning the dangers of substance abuse while participating in a exciting competitive activity. It is clear that the present invention is well adapted to carry out the objects and attain the ends and advantages mentioned as well as those inherent therein. While a presently preferred embodiment has been described for the purposes of this disclosure, numerous changes may be made which will readily suggest themselves to those skilled in the art and which are encompassed within the spirit of the invention disclosed and as defined in the appended claims.

What is claimed is:

1. A method for playing a substance abuse game board apparatus wherein players are educationally informed about substance abuse during a competitive environment, the game board apparatus comprising a game board having a playing surface, a plurality of movable game pieces, a random number generator, a plurality of challenge chips, a plurality of decks of question cards and a deck of penalty cards, the playing surface consisting of a plurality of playing segments and a plurality of corner penalty segments defining a substantially inwardly disposed spiral pathway extending from a starting position through successive levels to a counselor position, the method comprising:

giving each player a challenge chip prior to commencement of the game;

positioning a plurality of game pieces on a designated starting square of the game board;

obtaining a number from the random generator;

moving one of the playing pieces, in player turn, a selected number of spaces along the pathway as indicated by the random number generator, each of the segments, other than the corner penalty segments, having an identifying indicia corresponding to an identifying indicia of the decks of question cards and the deck of penalty cards;

selecting a card from the deck of cards corresponding to the indicia of the segment to which the playing piece has been moved;

answering the question on a card selected from the deck of question cards prior to movement of the game piece a selected number of spaces along the playing path as indicated by the random number generator when a correct answer is given to the question;

passing play to another player when an incorrect answer is given;

following the instructions on the penalty corner segments when the game piece is moved to such a penalty corner segment and, unless otherwise instructed, passing play to another player;

moving the game piece as required by a penalty card when the game piece is moved to a space bearing the identifying indicia corresponding to the identifying indicia of the deck of penalty cards and thereafter passing the die to the next player;

challenging a selected player one time during play of the game, prior to entry into the "counselor" position, in order to attempt to exchange the position of the challenging player's game piece on the playing path with the position of the challenged player's game piece on the playing path, the challenge being successful if the challenging player answers questions from question cards selected by the challenged player from a majority of the decks of question cards, the challenge being unsuccessful if the challenging player is unable to answer to each of the questions whereupon the game piece of the challenging player is moved to the starting position on the game board;

progressing along the playing path until correctly obtaining a number from the random number generator to permit the game piece to enter into the "counselor" position; and answering questions on a card drawn from each of the decks of question cards to be declared winner of the game.

2. The method of claim 1 further comprising:

passing the die to another player when incorrectly answering one of the questions drawn from each of the decks of question cards when the player's game piece is in the "counselor" space; and answering the missed question on the player's next turn in order to be declared the winner of the game.

3. A substance abuse game board apparatus for educationally informing players about substance abuse, the apparatus comprising:

a game board having a playing surface defining a pathway between a start position and a counselor position, the pathway consisting of a plurality of segments and corner penalty spaces, each of the segments having an identifying indicia;

a plurality of game pieces corresponding to a number of players, the game pieces movable in player turn selected distances along the pathway between the start position and the counselor position;

a random number generator for determining the selected distance one of the game pieces is moved in player turn, wherein the random number generator is a six-sided die;

a plurality of decks of question cards, each of the decks of question cards having an identifying indicia corresponding to the identifying indicia of a portion of the segments of the pathway; and a deck of penalty cards having an identifying indicia corresponding to the identifying indicia of a second portion of the segments of the path;

challenge means for challenging another player during the course of the game, the challenge means comprising a plurality of chips, one each of which being issued to each player to permit the player to challenge another player during the course of the game such that if the challenge is successful, the positions of the players' game pieces are exchanged on the pathway, the challenge player correctly answers questions from question cards selected from a majority of the decks of question cards; said pathway is a modified, substantially inwardly disposed spiral having an outer level, an intermediate level, and an inner level, each level having a plurality of segments, and wherein the outer level consists of a plurality of four different identifying indicia randomly disposed on the segments of said outer level and an identifying indicia on the corner penalty space, the intermediate level consists of a plurality of five different indicia randomly disposed on the segments of said intermediate level and an identifying indicia on the corner penalty spaces and the inner level consists of a plurality of six different identifying indicia randomly disposed on the segments of said inner level and an identifying indicia on the corner penalty spaces.

* * * * *